US005150825A

United States Patent [19]

Nichols

[11] Patent Number: 5,150,825

[45] Date of Patent: Sep. 29, 1992

[54] HOLSTER WITH RETENTION DEVICE

[76] Inventor: Richard E. D. Nichols, 13223 Black Mountain Rd., #357, San Diego, Calif. 92129

[21] Appl. No.: 639,587

[22] Filed: Jan. 9, 1991

[51] Int. Cl.[5] ..... F41C 33/02

[52] U.S. Cl. ..... 224/243; 224/242; 224/911; 224/247

[58] Field of Search ..... 224/243, 242, 247, 246, 224/244, 245, 911, 912, 193

[56] References Cited

U.S. PATENT DOCUMENTS

| | | | |
|---|---|---|---|
| D. 303,875 | 10/1989 | Hill | D3/101 |
| 609,317 | 8/1898 | Zimmerman | 224/193 |
| 981,292 | 1/1911 | Lewis | 224/193 |
| 1,322,198 | 11/1919 | Morrison | 224/193 |
| 1,629,700 | 5/1927 | Harter | 224/193 |
| 1,876,613 | 9/1932 | Clark | 224/193 |
| 2,758,762 | 8/1956 | Medley | 224/243 |
| 2,765,968 | 10/1956 | Gaylord, Jr. | 224/243 |
| 2,832,519 | 4/1958 | Ojala | 224/243 |
| 2,893,615 | 7/1959 | Caper | 224/912 X |
| 2,970,727 | 2/1961 | Bohlin | 224/243 |
| 3,011,687 | 12/1961 | Boyt | 224/243 |
| 3,252,638 | 5/1966 | Rolston et al. | 224/243 |
| 3,252,639 | 5/1966 | Sloan | 224/2 |
| 3,630,420 | 12/1971 | Bianchi | 224/243 |
| 3,923,214 | 12/1975 | Kippen | 224/2 |
| 4,205,768 | 6/1980 | Hill et al. | 224/193 |
| 4,225,067 | 9/1980 | Bianchi | 224/243 |
| 4,256,243 | 5/1981 | Bianchi et al. | 224/224 |
| 4,258,871 | 3/1981 | McMahon | 224/243 |
| 4,588,116 | 5/1986 | Litman | 224/148 |
| 4,694,980 | 9/1987 | Rogers | 224/243 |
| 4,696,419 | 9/1987 | Holtzclaw, Jr. et al. | 224/243 |
| 4,750,656 | 6/1988 | Bianchi et al. | 224/253 |
| 4,865,238 | 9/1989 | Bianchi | 224/911 |
| 4,925,075 | 5/1990 | Rogers | 224/224 |
| 4,955,518 | 9/1990 | Parsons et al. | 224/247 |
| 5,033,663 | 7/1991 | Bianchi et al. | 224/238 |

OTHER PUBLICATIONS

Mattel Inc Catalogue; Apr. 15, 1960; pp. 8-9 Fanner top grain holster sets and shootin' shell grain leather holster set.

Michaels of Oregon "Sidekick" Duty Holster for Autos; Michaels of Oregon 1990 Catalog.

Galco International Catalog: Models Phoenix, S.O.B., D.E.A. Paddle, Guardian, SSII.

Don Hume Catalog, p. 4, H724 Model.

Holsters International Limited Catalog, Holster Models GR, 50A.

Milt Sparks, Mar. 1988 Catalog, Model ST Gauntlet.

Davis Leather Co., Nov. 1989 Calatag, Models 22450/22450LC.

Ted Blocker Catalog, Aug. 1990, Model SP 200.

*Primary Examiner*—Henry J. Recla

*Assistant Examiner*—Keith Kupferschmid

*Attorney, Agent, or Firm*—Brown, Martin, Haller & McClain

[57] ABSTRACT

A holster of soft material has a retention device for applying pressure to a handgun in the holster to resist inadvertent removal of the handgun. An elongate band or strip of resilient material is formed into a loop around the outside of the holster by folding the band about a central region extending over a fold in the holster and securing opposite ends of the band together through the holster to urge the opposite side portions of the band towards one another. The opposite side portions of the band compress corresponding underlying wall portions of the holster against a handgun in the holster pocket, providing a controlled resistance to draw which is preferably adjustable and also resisting inadvertent removal or slipping of the handgun out of the pocket.

17 Claims, 2 Drawing Sheets

HOLSTER WITH RETENTION DEVICE

BACKGROUND OF THE INVENTION

The present invention relates generally to holsters for handguns and is particularly concerned with a retention or adjustable tension device for holsters of relatively soft material such as fabric or soft leather for resisting removal or inadvertent slipping of a handgun from its holster.

Retaining a handgun in its holster has long been a goal of holster makers. The earliest retention devices comprise simple flap holsters, which flaps combined retention of the handgun with protection of the handgun from the elements.

Straps and flaps are well known to holster makers as simple means of retaining the handgun. These devices have their advantages and disadvantages. Principal among the disadvantages is that many such devices must be first unfastened, then moved aside while the handgun is withdrawn, resulting in a two-step drawing motion. Secondly, such devices lose their effectiveness as soon as they are released, and must be refastened to regain their ability to retain the handgun. Although strap systems such as the thumb-break strap have reduced or eliminated the principal disadvantage, the second disadvantage continues.

As the needs of the user became more sophisticated, so did the solutions of the holster designers. A variety of patented and unpatented solutions appeared, the bulk of them being since the 1960's. It was learned that many professionals, either in law enforcement or in shooting competition, had a need to be able to quickly withdraw their handguns without manipulating any devices beforehand, and then be able to reholster as quickly, also without manipulating any devices such as straps or slaps. These solutions have typically been adjustable devices which provide some form of friction on the firearm, yet allow the handgun to be drawn in a conventional upwards manner (for a belt-mounted holster) using a practical level of force to withdraw the handgun.

Other devices dating back to the 1920's and earlier which include springs and locking devices, have required that either the handgun or the device be manipulated to release the handgun.

The need by the user to withdraw and reholster his handgun quickly without the need for a separate motion to unfasten a strap or other device to slow him down, is further complicated by the continuing need for handgun retention. When a holster is manufactured without a strap, or when a strap is included but it loses its ability to retain after the strap is opened as described above, the concern of both the user and the maker is then to provide for securing the gun the possibility of the handgun falling out to the ground, especially during strenuous activity by the wearer. While no holster can absolutely prevent a handgun from falling out or being taken out by the unauthorized, some prior retention devices have achieved some measure of success here.

The problems of handgun retention are particularly evident in the type of holster known as the horizontal shoulder holster. In this type of holster the handgun is carried under the wearer's arm with the handgun barrel parallel to the ground. The handgun grip is to the front of the wearer, and the bottom of the grip is towards the ground. This method of carrying the handgun is compact and comfortable, and such holsters have become a staple of the modern holster manufacturing company. Typically the horizontal shoulder holster is equipped with a thumb-break safety strap to both retain the handgun and to block the hammer of the handgun into the cocked or uncocked position, as appropriate. Once the strap is unfastened, though, the wearer relies on the tight fit of the holster, his own vigilance, and his refastening of the strap to retain the handgun. A secondary means of retaining the handgun, such as a friction device, can improve the holster's ability to retain the handgun in such a horizontal shoulder holster after the strap is unfastened.

As a secondary means of retention, some holster makers have used friction devices in all types of holsters to press on the handgun, including those carried on the belt and those carried under the arm. typically these devices are adjustable to compensate for the "wearing in" of the holster and for adjustment to suit the level of resistance to draw that may be preferred by the individual user. Generally these have all worked best for holsters which are rigid, such as molded all-leather holsters, leather holsters with internal reinforcements of metal, molded hard plastic holsters, and fabric holsters with exterior reinforcements of plastic.

However, the soft fabric holster has grown in popularity in the world market over the last ten years—especially in the United States—while the relative sophistication of the retention devices has not kept pace with this new popularity. A part of this is due to the fact that fabric holsters as they are currently embodied are often inexpensive products, and that can preclude a manufacturer from incorporating features that add cost, including retention devices. Yet the needs of the wearer for comfort, security, speed, and so on continue to be the same as when the wearer used traditional leather holsters.

In addition to the cost disadvantage, there is the difficulty of providing such features as the adjustable tension device in fabric holsters because such holsters are, by their nature, quite soft. Simply applying the prior art, which typically relies at least in part on the relatively stiff nature of molded saddle leather and any metal reinforcements, has proven to be inadequate or not cost effective.

Most tension devices, or devices for providing controllable resistance to draw, used in holsters to date have been applied to molded leather holsters where either the stiff leather or an internal metal reinforcement will transfer the clamping action of the tension device to the handgun and thereby provide retention.

A well-known device to those schooled in the art is that once used by Andy Anderson on his "Thunderbolt" competition holsters, and now by those who have emulated Anderson. This device was a large, spring-loaded wing-nut affair affixed to the outside of the holster; tightening the device produced a gripping action on the flat side of the handgun. The device was relatively bulky and suited only to the shooting range.

Today many holster makers use another, more compact device on their leather holsters. This device is typically a two-part metal or plastic fastener known as a post and screw. The post is inserted through the front of the holster, the screw through the back, and a rubber grommet is placed inside the holster between the post and screw. This grommet variously shields the handgun from the metal fastener; expands or distorts to grip the handgun when the screw is tightened; and serves as a compression spring to return the holster to its original size when the screw is loosened. Commonly such holsters have full internal metal or hard plastic plates which extend throughout the holster blank, or metal bands extending around the pistol from the tension screw on the inside of the holster. In holsters which are equipped with such bands, the metal is soft and in two pieces, and is laminated inside the holster. Using a harder metal, such as spring steel, inside the holster is usually avoided due to manufacturing difficulties and the inadequacy of the finished product. When spring steel is used, the goal has been to form a deformable spring clamp through which the handgun can be drawn.

Fabric holsters are also sometimes equipped with a permanent plastic sheet reinforcement of constant thickness which is permanently attached to the holster and covers the lower half of the holster and places the tension screw at the muzzle of the pistol.

This technique has some disadvantages. A custom part must be die cut for each different holster, and the material used easily takes a "set" over time which can lead to reduced retention of the handgun. The sheet must be held in place and attached by skilled sewing operators and does not provide a positive stop for the pistol when the pistol is inserted into the holster. The hard plastic edge under the decorative edge binding can also cause the binding to fray from external and internal abrasion.

U.S. Pat. No. 3,252,639 of Sloan describes an adjustable tension device for holsters. In this device, the spacer or "welt" in the holster seam is left free at the uppermost end. In the welt is a slot, and through the slot is a post and screw device. To adjust the tension on the pistol, or to tighten the holster as the leather wears in, the device is loosened and the welt is moved inward or outward to achieve the desired effect; then the screw is tightened to hold this setting. This device relies on the spacer or welt actually touching the handgun.

U.S. Pat. No. 3,923,214 of Kippen describes an adjustable tension device with an internal resilient washer. The device has been used in essentially this form on many products. It relies on the rigidity of a formed leather holster to provide a lasting basis for the device's function.

U.S. Pat. No. 4,205,768 of Hill describes a holster with adjustable tension provided by means of a metal reinforcement, with the rear seam closed by a velcro-lined flap. Adjusting the velcro flap allows the holster pocket to be made smaller or larger to fit the handgun.

U.S. Pat. No. 4,225,067 of Bianchi/Nichols describes a holster which is fully reinforced with metal, a layer of which is laminated between the inside and the outside layers of leather. Also inside the layers and attached to the metal sheet is a small section of spring steel. An external screw bears on this metal strip; tightening the screw presses the strip toward the pistol. This device relies on a full metal reinforcement inside the holster.

U.S. Pat. No. 4,256,243 of Bianchi/Nichols describes a retention device comprising a spring steel finger, which is an external device equipped with a plastic knob which protrudes through the holster and into the pistol's trigger guard.

U.S. Pat. No. 4,750,656 of Bianchi/Nichols/Miller describes a holster using a resilient washer for adjustment purposes. Washers of differing size may be used to permit the holster to fit different size handguns. In practice the washer is riveted in place and provides little tensioning effect, adjustable or otherwise. It is most effective as a stop for the pistol and as a welt reinforcement.

U.S. Pat. No. 4,925,075 of Rogers describes a complex adjustable tension device which allows a straight up draw. This device is intended for use in competition-type holsters. Adjustable tension is supplied by a cored-out plastic block, with a plastic finger extending into the block and subsequently into the pistol's trigger guard. The device has limited adaptability to different size handguns.

Current adjustable tension or retention devices are for the most part not suited for use with fabric or other soft material holsters and are in some cases prohibitively complex and expensive.

SUMMARY OF THE INVENTION

It is an object of the present invention to provide a new and improved retention or tensioning device for providing an adjustable resistance to draw, which may be arranged to reduce the risk of inadvertent or unauthorized removal of handguns from holsters of soft material such as fabric, soft leather or the like.

According to the present invention a retention device for a soft material holster is provided which comprises an elongate band of resilient material of a hardness greater than that of the holster material, and a fastener device for extending through the holster body in a region adjacent a lower or rear edge of the handgun receiving pocket to secure opposite ends of the band together with the band extending in a loop around the opposite edge of the holster in a direction transverse to the handgun receiving pocket and biasing the side walls of the pocket inwardly against underlying portions of a handgun in the pocket to grip the gun and resist inadvertent removal.

Preferably, the band is relatively narrow as compared to the length of the holster handgun receiving pocket or cavity, and has a width no greater than $\frac{1}{3}$ of the overall length of the holster. This produces a tightly focused application of gripping pressure against the underlying handgun surface areas, improving the gripping action.

The band is of any suitable material having sufficient hardness to grip a handgun, such as engineering quality plastic such as nylon, Delrin® (registered trademark), polyurethane or the like, lower quality plastics, or spring steel. In a preferred embodiment, the band is of engineering quality plastic material and is thicker at its opposite end portions which will overlie opposite side walls of the holster pocket than in its central portion which forms the fold of the band extending over the principle fold of the holster. With this variable thickness along the length of the band, the opposite end portions which do not have to be bent or deformed significantly can be made sufficiently thick to grip the handgun without taking a set and potentially losing some or all of the retention ability of the device, while the central portion which must be bent to form a U-shape or loop can be made thinner so that the band bends more easily without being too bulky. The band may be of uniform width along its length, or may have a wider region at the fold or pinch of the loop to resist pivoting of the band during use of the holster and to increase retention in this area.

The thicker end portions of the band will resist inward deflection by the fastener mechanism urging them towards one another, and will press inwardly against the underlying side walls of the holster cavity to compress the holster in this region and apply pressure to underlying portions of the handgun and help to retain it in the holster and provide a controlled resistance to drawing the gun, and to resist inadvertent removal.

Preferably, the band is removably secured to the holster via the fastener mechanism, which may, for example, comprise a tension screw assembly extending through aligned holes in the opposite ends of the band and the underlying portions of the holster body. The tension screw assembly comprises an internally threaded post member having a head at one end, and a screw for releasable engagement in the threaded bore at the opposite end of the post. The post member extends through one end of the band and through the underlying holster body from one side, while the screw extends through the opposite end of the band on the opposite side of the holster for releasable engagement with the post. The user can therefore vary the amount of resistance to draw by tightening or loosening the screw as desired. The length of the post will control the minimum spacing between the opposite ends of the band and thus the maximum pressure applied to the gun. Annular washers of varying width and thickness may be selectively mounted inside the holster between the post and screw to control the effective width of the pocket at its lower or rear end, to accommodate handguns of differing sizes, and to shield the handgun from the metal fastener. The device may be used without a grommet for slim-line guns.

Since the band is removably mounted on the outside of the holster body, it can be easily serviced or replaced when worn. If desired, the band may be replaced with an alternative band having different properties, such as a stiffer band for increased resistance to draw, or a softer band. Although the band is preferably removably secured to the holster body via an adjustable tension screw assembly, it may be permanently attached via rivets or the like where the application warrants such an arrangement.

The band may be provided with a series of two or more spaced holes at its opposite ends for allowing the same basic band to be selectively fitted around any one of a large variety of handgun holsters of varying sizes, for holding small revolvers to large pistols.

The retention device of this invention is simple and inexpensive, and can be applied to soft material holsters of any design. The device will allow an adjustable, controlled resistance to draw, and can be arranged to resist inadvertent removal or slipping of a handgun from such a holster by applying a localized, focused gripping force against the underlying surfaces of the handgun in the region surrounded by the gripping band.

BRIEF DESCRIPTION OF THE DRAWINGS

The present invention will be better understood from the following detailed description of a preferred embodiment, taken in conjunction with the accompanying drawings, in which like reference numerals refer to like parts, and in which.

DESCRIPTION OF THE PREFERRED EMBODIMENTS

Figure 1:
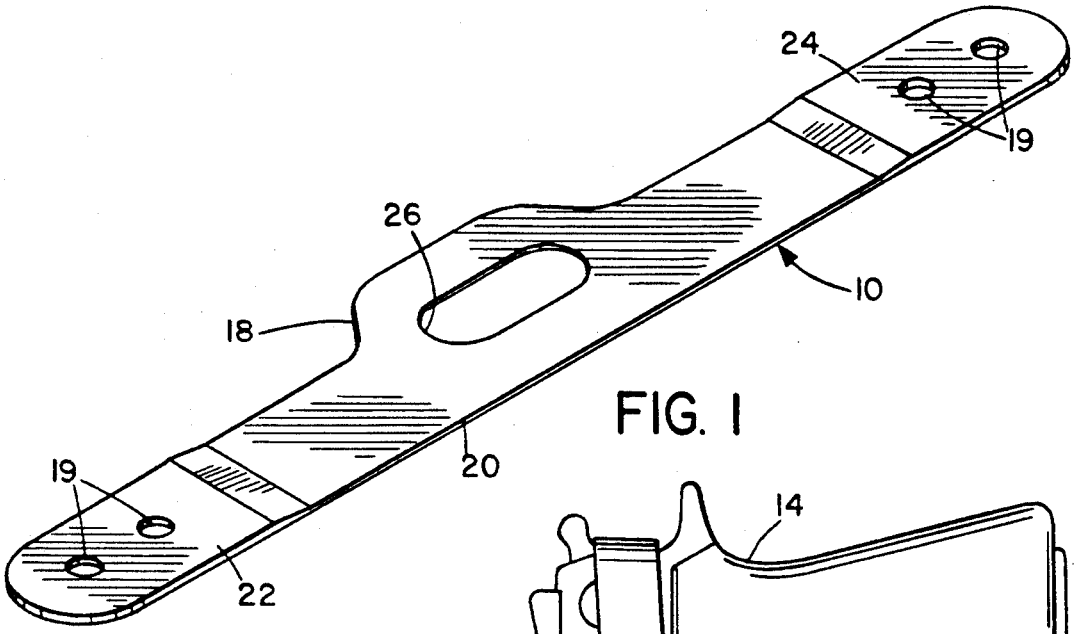
FIG. 1 is a perspective view of a basic configuration of the retention band according to a preferred embodiment of the present invention.
Figure 2:
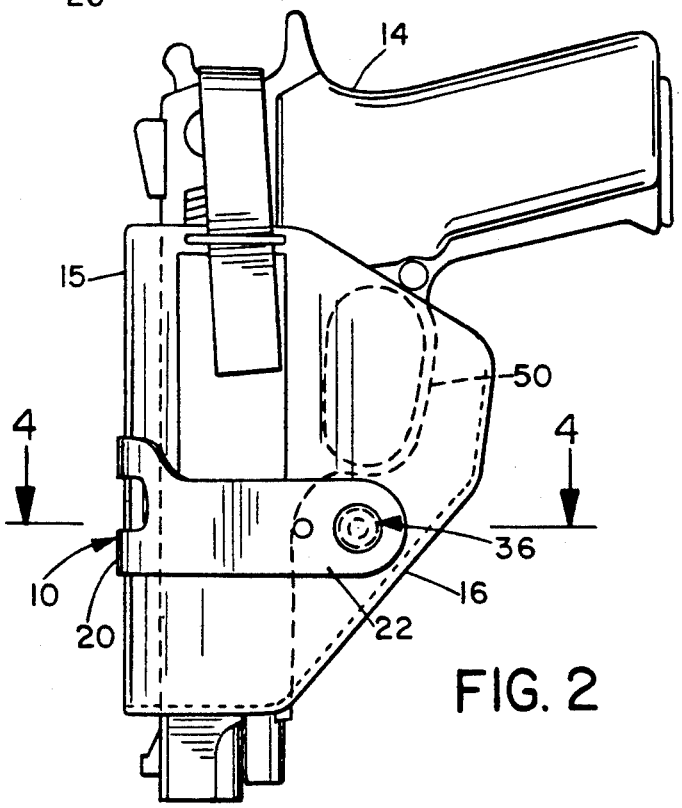
FIG. 2 is a side elevation view of a typical holster incorporating the retention band, with a semi-automatic pistol held in place.
Figure 3:
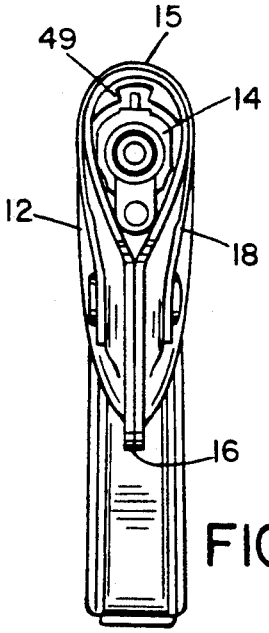
FIG. 3 is a front end view of the holster and pistol.
Figure 4:
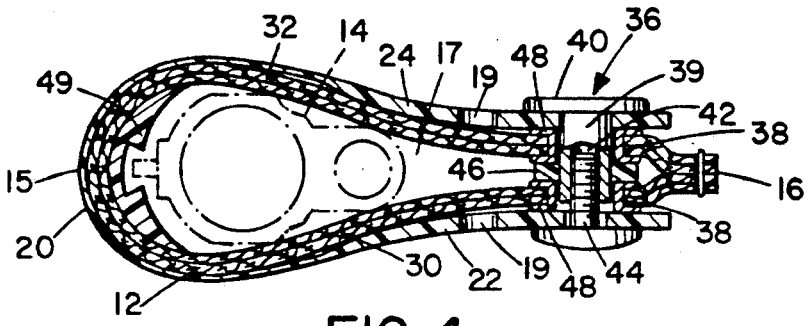
FIG. 4 is an enlarged sectional view taken on line 4—4 of FIG. 2.

FIG. 1 of the drawings illustrates a retention or restraining device 10 according to a preferred embodiment of the present invention for securing to a holster 12 of soft material such as fabric, soft leather, or the like, as illustrated in FIGS. 2 to 4, to press against the underlying surfaces of a handgun or pistol 14 in the holster and resist inadvertent removal of the gun, as will be explained in more detail below. The holster illustrated in the drawings is of soft fabric material or the like folded about a front or principle fold 15 and secured together about its opposite, rear edges 16 by sewing or the like to form a handgun receiving pocket 17 of appropriate shape and dimensions. However, it will be understood that the retention device may be applied to other, alternative soft material holster designs, for example holsters with both front and rear folds, in a similar manner. The holster may be one designed for use as a horizontal shoulder or belt holster, or a vertical belt attached holster, or for use in any standard orientation.

The retention device 10 basically comprises an elongate, flat band 18 of a suitable material which has some flexibility and which is harder than the material forming the holster 12. The band has one or more openings 19 at each end, and is preferably of varying or stepped thickness, with the central region 20 being thinner and more flexible than the opposite end portions 22, 24 of the band, as best illustrated in FIGS. 1 and 4. The band may be formed of any suitable material such as engineering quality plastic, commodity plastic or other plastic materials, spring steel, or similar materials. In the preferred embodiment illustrated, the band is of engineering quality plastic. The band is preferably wider in its central region 20 than at its opposite end portions, although it may be of uniform width along its length in alternative embodiments. The central region has an elongate central slot or cut out 26 for increased flexibility.

The band 16 is secured to the holster as illustrated in FIGS. 2 to 4 by forming it into a loop folded about central, reduced thickness region 20 and extending it around the outer surface of the holster with the loop or folded central region extending around the front or upper fold 15 of the holster material and the opposite end portions 22, 24 extending over the opposite side wall portions 30, 32 of the holster defining the handgun receiving pocket 17, in a direction transverse to the pocket, with holes 19 in the opposite end portions aligned. The opposite ends of the band are secured together and urged towards one another via a releasable fastener mechanism 36, which in the preferred embodiment of the invention comprises a post and screw assembly, which extends through one pair of aligned holes 19 in the opposite ends of the band and corresponding, aligned through holes 38 provided in the opposing side wall portions of the holster itself adjacent the rear of the handgun receiving cavity. The provision of two or more spaced holes 19 at each end of the band allows adjustment of the band for fitting around holsters and handguns of different dimensions.

The fastener mechanism 36 is best illustrated in FIG. 4 and basically comprises a post 39 having an enlarged head 40 at one end and a screw threaded bore 42 extending from the opposite end, and a screw 44 for screw threaded engagement in bore 42. The post 39 extends through one end 22 of the band or strap 16 and through the aligned opening or holes 38 extending through the opposite sides of the holster, while the screw 44 extends through the aligned hole in the opposite end 24 of the band for threaded engagement in bore 42. Depending on the handgun dimensions, an annular washer 46 of resilient material may be mounted on post 38 inside the pocket between the inner faces of the side wall portions of the holster. Thin rigid eyelets or grommets 48 extend through each of the holes 38 in the soft fabric of the holster for increased rigidity.

With this arrangement, tightening of screw 44 will act to urge the opposite end portions 22, 24 of the band towards one another, simultaneously pinching the underlying side wall portions of the handgun receiving pocket inwardly towards one another against underlying portions of a handgun located in the pocket, as best illustrated in FIG. 4, pressing against the underlying handgun surface portions to grip the handgun and increase resistance to removal of the handgun from the pocket. This allows the wearer to select the amount of resistance to draw as desired, and can also reduce the risk of the handgun inadvertently slipping from the holster. The central portion 20 of the band will also provide some compression of the holster body against the handgun, but serves the principal function of joining the two thicker end portions of the device together. Since the band is thinner in central portion 20, it can be easily folded at this point to form the desired loop around the outside of any holster, while the thicker end portions resist deflection by the fastener mechanism joining the ends together through the holster, thereby pressing against the holster and underlying handgun. The thicker end portions are thick enough to reduce or eliminate the risk of setting of the material into its deflected configuration, which would reduce or eliminate its effectiveness. The central portion 20 is preferably wider than the remainder of the band as in the preferred embodiment illustrated, resisting pivoting of the band about the fastener post which could otherwise occur if the fold of the holster is only loosely pressed against the fold of the retaining band. This increased width also applies pressure over a wider area for enhanced retention.

The retention band 18 is relatively narrow as compared to the overall length of the holster, as can be seen in FIG. 2, and preferably has a width no greater than $\frac{1}{3}$ of the length of the handgun receiving cavity 17 of the holster. This produces a localized enhanced gripping action. The band is preferably appropriately positioned on the holster so that it will also act as a trigger guard stop, by pinching the underlying holster side wall portions together at an appropriate location adjacent the trigger guard of a handgun. When a pistol 14 is inserted into the cavity, the pinched regions will act as a stop against the forward edge 50 of the trigger guard, preventing the gun from being pushed too far into the cavity.

The variable thickness of the retention band enables the end portions of the band to be thick enough to remain effective after repeated tightening and loosening, while not adding significantly to the overall bulk of the holster when applied, since the fold of the band is relatively thin. In one particular example of a band of engineering quality plastic material, such as nylon or Delrin, the band thickness varied from around 1/16 inch at the center to around $\frac{1}{8}$ inch at the thicker opposite end portions for applying pressure to the handgun to retain it against inadvertent removal. In one example of a band as illustrated in FIG. 1 the width of the band was around 1 inch at the end portions and 1.5 inches at the center, and this has been found to produce a good gripping action although the device will also function if the band is made wider or narrower, and if the band is of uniform width or even narrower at the center, although to a lesser degree.

As illustrated in FIG. 4, the holster may have a sight protection device 49, as described in my co-pending application Ser. No. 07/639,588 entitled "Holster With Sight Protection Device" filed on Jan. 9, 1991, applied to the inner surface of its principle fold. The band used in conjunction with sight protection device 49 enhances the operation of both parts, gripping the handgun to maintain its desired orientation.

Figure 5:
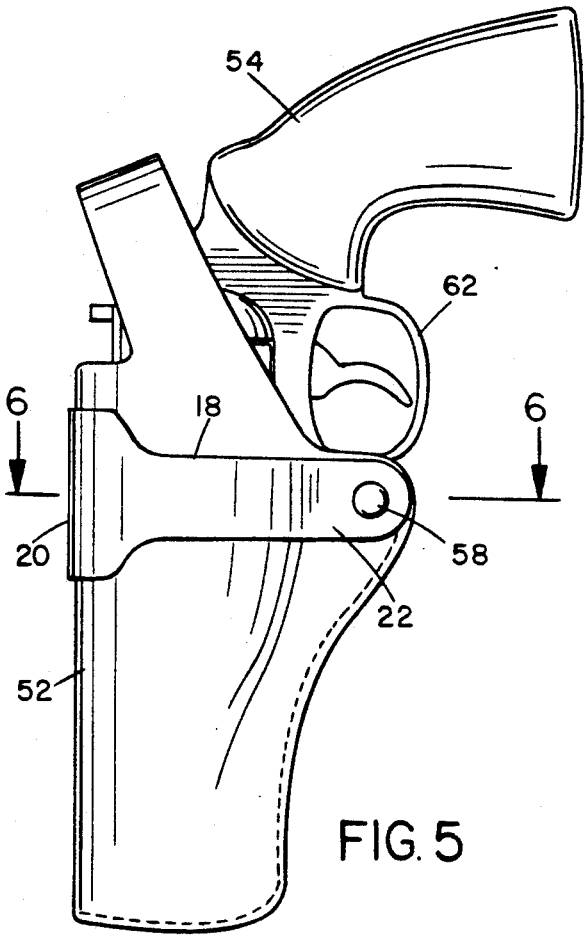
FIG. 5 is a side elevation view of a typical revolver and holster incorporating the retention band.
Figure 6:
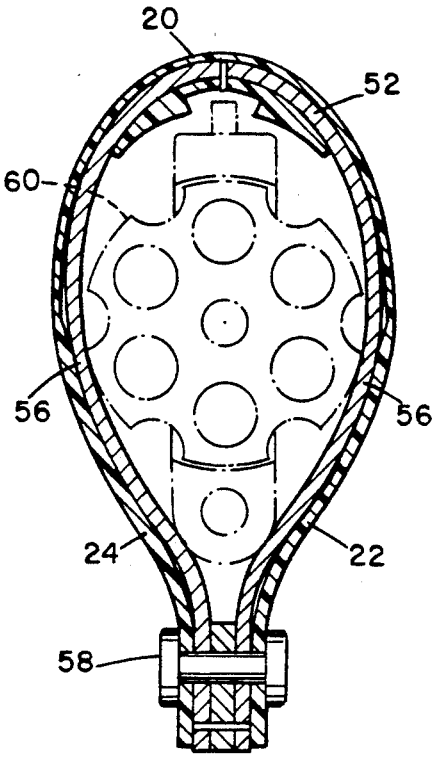
FIG. 6 is an enlarged sectional view taken on line 6—6 of FIG. 5.

In FIGS. 2 to 4, the retention band 18 is shown applied to a typical holster 12 for a semi-automatic pistol 14, with the band appropriately located so that it will function to urge the sides of the holster inwardly to grip the lower frame and barrel portion of the pistol 14, as illustrated in FIG. 4, and also to act as a pistol guard stop for ensuring proper positioning of the pistol in the holster, as illustrated in FIG. 2. FIGS. 5 and 6 illustrate the same retention band as applied to an alternative type of holster 52, in this case a holster for receiving a revolver 54. The band 18 is substantially identical to that illustrated in FIGS. 1 to 4, and like reference numerals have been used where appropriate. As in the previous embodiment, the band is formed into a loop over the holster with its opposite ends portions extending over the corresponding opposite sides 56 of the holster. In FIGS. 5 and 6, the band is not removably mounted on the holster but is riveted in place via a suitable rivet 58 extending through the opposite ends of the band and underlying side wall regions of the holster, as illustrated in FIG. 6. However, the band may alternatively be removably secured to the holster as in FIGS. 2 to 4, if desired. Additionally, the positioning of the band on the holster is different in FIGS. 5 and 6 from that in FIGS. 2 to 4. In FIGS. 5 and 6, the band is situated closer to the entry end of the holster, so that it will extend around the cylinder 60 of the revolver 54, urging the underlying sides 56 of the holster inwardly in this region to grip the cylinder 60 as illustrated in FIG. 6. Additionally, the sides 56 of the holster are pinched together in this region to act as a stop against the forward edge of trigger guard 62, as best illustrated in FIG. 5, preventing the revolver from being pushed too far into the holster.

Although the band is preferably removably mounted on the holster, allowing easy service and replacement as necessary, it may alternatively be secured at appropriate points such as at the fold and/or at one of its ends by rivets or screws, as in FIGS. 5 and 6, to preclude any possibility of the band becoming separated from the holster. An additional, adjustable tension screw may also be provided in this case to allow the user to adjust for increased or decreased gripping force, as desired. Whether removably or permanently secured to the holster, the band can be applied easily to any existing soft holster body during or subsequent to manufacture.

Figure 7:
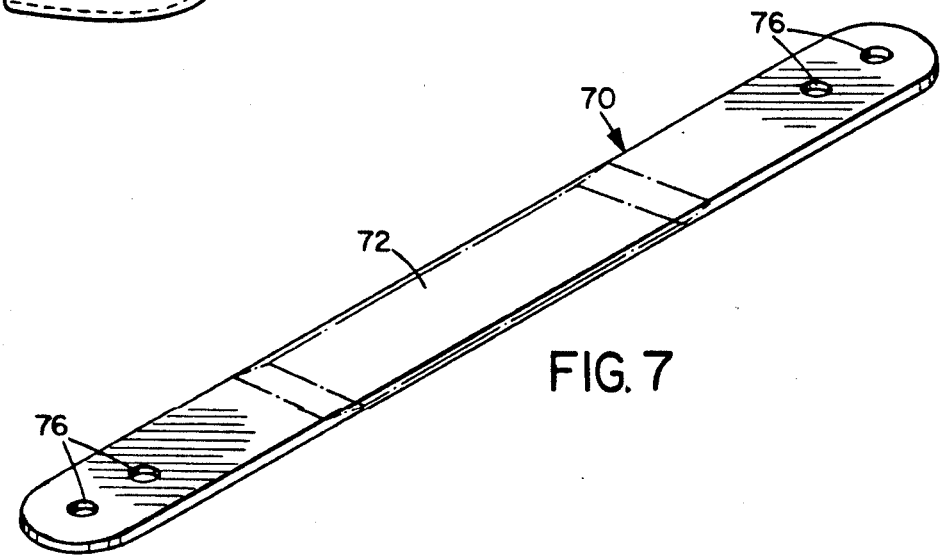
FIG. 7 is a perspective view of a simplified configuration of the retention band.

FIG. 7 illustrates a simplified version of the retention device, comprising a band 70 of substantially uniform length and thickness which can be removably secured around a holster in a similar manner to that illustrated in FIGS. 2 to 6. This version will use less material than the first embodiment in which the band is wider in the central region. The uniform width band may have a reduced thickness in the central region 72, as indicated in dotted outline in FIG. 7, for increased foldability in this region and more rigidity in the end portions, or may alternatively be of uniform thickness along its length for reduced manufacturing costs. Preferably, holes 76 are provided at spaced intervals in each end portion of the band, as in the first embodiment, for receiving a suitable fastener mechanism for releasably securing the ends of the band together to a selected holster.

In the version of FIGS. 2 to 4, with the retention band in place, the user can adjust the tension or resistance to draw simply by tightening or loosening the screw, which allows the user to select the amount of resistance to the draw as he may desire. In each of the above alternatives, the band provides additional resistance to the handgun accidentally slipping from the holster, for example after a primary retention device such as a releasable strap is released. The device is simple to manufacture and instal, is of relatively low cost, and is suitable for use with all current soft holster technologies, including fabric, non-reinforced or soft leather, and the like. The band may also be advantageously used with harder material holsters, as illustrated in FIGS. 5 and 6, for example; with the band being a harder material than the holster (for example, metal).

Although a preferred embodiment of the invention has been described above by way of example only, it will be understood by those skilled in the field that modifications may be made to the disclosed embodiment without departing from the scope of the invention, which is defined by the appended claims.

I claim:

1. A holster for a handgun, comprising:

a holster body having an elongate, handgun receiving pocket extending along its length and open at least at one end for inserting a handgun into the pocket, the holster body having at least one fold and spaced, opposing side wall portions extending from the fold to form opposite sides of the pocket;

an elongate band of resilient material having a hardness greater than the material forming the holster body, the band extending transversely around the outside of at least part of the holster body in a direction substantially perpendicular to the longitudinal axis of the pocket, and having a fold at a central portion in its length overlying said one fold in the holster body and opposite end portions extending over the respective side wall portions of the holster body;

fastener means for connecting opposite ends of the band together and securing the band to the holster body;

the end portions of the band comprising means for pinching underlying side wall portions of the holster inwardly to apply a retentive force to grip underlying portions of a handgun in the pocket; and opposite ends of the band having aligned openings and said fastener means extending through said aligned openings and the aligned underlying portion of the holster body to secure said band ends to the holster body, said band being secured to the holster body only by said fastener means.

2. The holster as claimed in claim 1, wherein said fastener means comprises a releasable fastener mechanism for releasably securing said band to the holster body.

3. The holster as claimed in claim 2, wherein said fastener mechanism comprises a first part extending through the opening in one end of the band and a second part releasably securable to the first part extending through the opening in the opposite end of the band.

4. The holster as claimed in claim 3, wherein the first part comprises a post having an enlarged head at one end and a threaded bore at the opposite end, and the second part comprises a screw member for adjustable threaded engagement in said bore.

5. A holster for a handgun, comprising:

a holster body having an elongate, handgun receiving pocket extending along its length and open at least at one end for inserting a handgun into the pocket, the holster body having at least one fold and spaced, opposing side wall portions extending from the fold to form opposite sides of the pocket;

an elongate band of resilient material having a hardness greater than the material forming the holster body, the band extending transversely around the outside of at least part of the holster body in a direction substantially perpendicular to the longitudinal axis of the pocket, and having a fold at a central portion in its length overlying said one fold in the holster body and opposite end portions extending over the respective side wall portions of the holster body;

fastener means for connecting opposite ends of the band together and securing the band to the holster body;

the end portions of the band comprising means for pinching underlying side wall portions of the holster inwardly to apply a retentive force to grip underlying portions of a handgun in the pocket; and said fastener means comprising means for controlling the transverse separation between the opposite end portions of the band for varying the retentive force of said band.

6. The holster as claimed in claim 5, wherein said band is of varying thickness, the band being thinner in its central folded region than at its opposite end portions.

7. The holster as claimed in claim 5, wherein the band is wider at its central region than at its opposite end portions.

8. The holster as claimed in claim 5, wherein the band is of engineering quality plastic material.

9. The holster as claimed in claim 5, wherein the width of the band is no greater than $\frac{1}{3}$ of the length of the handgun receiving pocket in the holster.

10. The holster as claimed in claim 5, wherein said band extends transversely around said holster at a location immediately adjacent to the location of the trigger guard of a handgun inserted in said pocket, and further comprises means for pinching the sides of the holster together to form a trigger guard stop.

11. A holster for a handgun, comprising:

a holster body having an elongate, handgun receiving pocket extending along its length and open at least at one end for inserting a handgun into the pocket, the holster body having at least one fold and spaced, opposing side wall portions extending from the fold to form opposite sides of the pocket;

an elongate band of resilient material having a hardness greater than the material forming the holster body, the band extending transversely around the outside of at least part of the holster body in a direction substantially perpendicular to the longitudinal axis of the pocket, and having a fold at a central portion in its length overlying said one fold in the holster body and opposite end portions extending over the respective side wall portions of the holster body;

fastener means for connecting opposite ends of the band together and securing the band to the holster body;

the end portions of the band comprising means for pinching underlying side wall portions of the holster inwardly to apply a retentive force to grip underlying portions of a handgun in the pocket; and the band being wider at its central region than at its opposite end portions, and the wider central region having a central cut-out area.

12. A retention device for applying a restraining force to a portion of a handgun in a handgun receiving pocket of a handgun holster, the device comprising:

an elongate flat band of resilient material having a hardness greater than that of the holster with which it is used;

fastener means for connecting opposite ends of the band together with the band forming a loop around the outside of the holster transverse to the handgun receiving pocket in the holster and opposite end portions of the band comprising means for urging the underlying portions of the holster body inwardly to grip underlying portions of a handgun in the pocket; and said band having at least one hole at each end and said fastener means comprising means for extending through said holes in each end of the band to secure said ends together.

13. The device as claimed in claim 12, wherein the band is of varying thickness along its length and has a central region of a first thickness and opposite end regions on opposite sides of the central region which are each of a second thickness greater than said first thickness.

14. The device as claimed in claim 12, wherein the band is of varying width along its length and has a central region which is wider than the remainder of the band on opposite sides of said central region.

15. The device as claimed in claim 12, wherein the band has at least two longitudinally spaced holes at each end for selective engagement by said fastener means.

16. A retention device for applying a restraining force to a portion of a handgun in a handgun receiving pocket of a handgun holster, the device comprising:

an elongate flat band of resilient material having a hardness greater than that of the holster with which it is used;

fastener means for connecting opposite ends of the band together with the band forming a loop around the outside of the holster transverse to the handgun receiving pocket in the holster and opposite end portions of the band comprising means for urging the underlying portions of the holster body inwardly to grip underlying portions of a handgun in the pocket; and said fastener means comprising a post member having an enlarged head at one end for extending through one end of said band and through aligned holes in opposite side wall portions of a holster, the post member having a threaded bore, and a screw member for extending through the opposite end of said band for adjustable threaded engagement in said threaded bore in said post member.

17. The device as claimed in claim 16, wherein said fastener means includes an annular washer located on said post for location between the opposite side wall portions of the holster.

* * * * *